US005339837A

United States Patent [19]

Hirsch et al.

[11] Patent Number: 5,339,837

[45] Date of Patent: Aug. 23, 1994

[54] DRYING PROCESS FOR INCREASING THE FILLING POWER OF TOBACCO MATERIAL

[75] Inventors: Werner Hirsch, Hamburg; Arno Weiss, Norderstedt; Erhard Rittershaus, Hamburg; Gitta Jünemann, Hamburg; Caspar H. Koene, Hamburg; Ingo Pautke, Hamburg; Fritz Schelhorn, Bayreuth; Herbert Sommer, Hamburg, all of Fed. Rep. of Germany; William J. Stone, Calmore, United Kingdom

[73] Assignee: B.A.T. Cigarettenfabriken GmbH, Hamburg, Fed. Rep. of Germany

[21] Appl. No.: 882,866

[22] Filed: May 14, 1992

[30] Foreign Application Priority Data

May 27, 1991 [DE] Fed. Rep. of Germany ..... 4117329

[51] Int. Cl.[5] ..... A24B 3/18

[52] U.S. Cl. ..... 131/296; 131/302; 131/303; 131/304; 131/306

[58] Field of Search ..... 131/291, 296, 302, 303, 131/304, 306

[56] References Cited

U.S. PATENT DOCUMENTS 4,407,306 10/1983 Hibbitts ..... 131/296

FOREIGN PATENT DOCUMENTS 3037885 5/0682 Fed. Rep. of Germany .
3147846 6/1683 Fed. Rep. of Germany .
3130778 9/1985 Fed. Rep. of Germany .
3246513 7/2183 Fed. Rep. of Germany .
3441649 5/3085 Fed. Rep. of Germany .

*Primary Examiner*—Theatrice Brown
*Assistant Examiner*—William M. Pierce
*Attorney, Agent, or Firm*—Armstrong, Westerman, Hattori, McLeland & Naughton

[57] ABSTRACT

In a drying process for increasing the filling power of tobacco material, the cut and moistened tobacco material is conveyed in a drying gas flow, dried within a tubular drying section and subsequently separated from the drying gas. The drying gas has at a feed point into the drying section a temperature of at least 200° C. and a flow velocity of at least 30 m/sec. The flow velocity of the drying gas is reduced in the drying section. The flow velocity of the drying gas at the charge point into the drying section is at the most 100 m/sec. Within the drying section, to reduce the local heat transfer coefficient and the local mass transfer coefficient between the surface of the tobacco material and the surrounding drying gas, along with the reduction of the flow velocity of the drying gas, the flow velocity of the tobacco material is also reduced. At the end of the drying section the drying gas has a flow velocity of at the most 15 m/sec and a temperature of at the most 130° C.

20 Claims, 1 Drawing Sheet

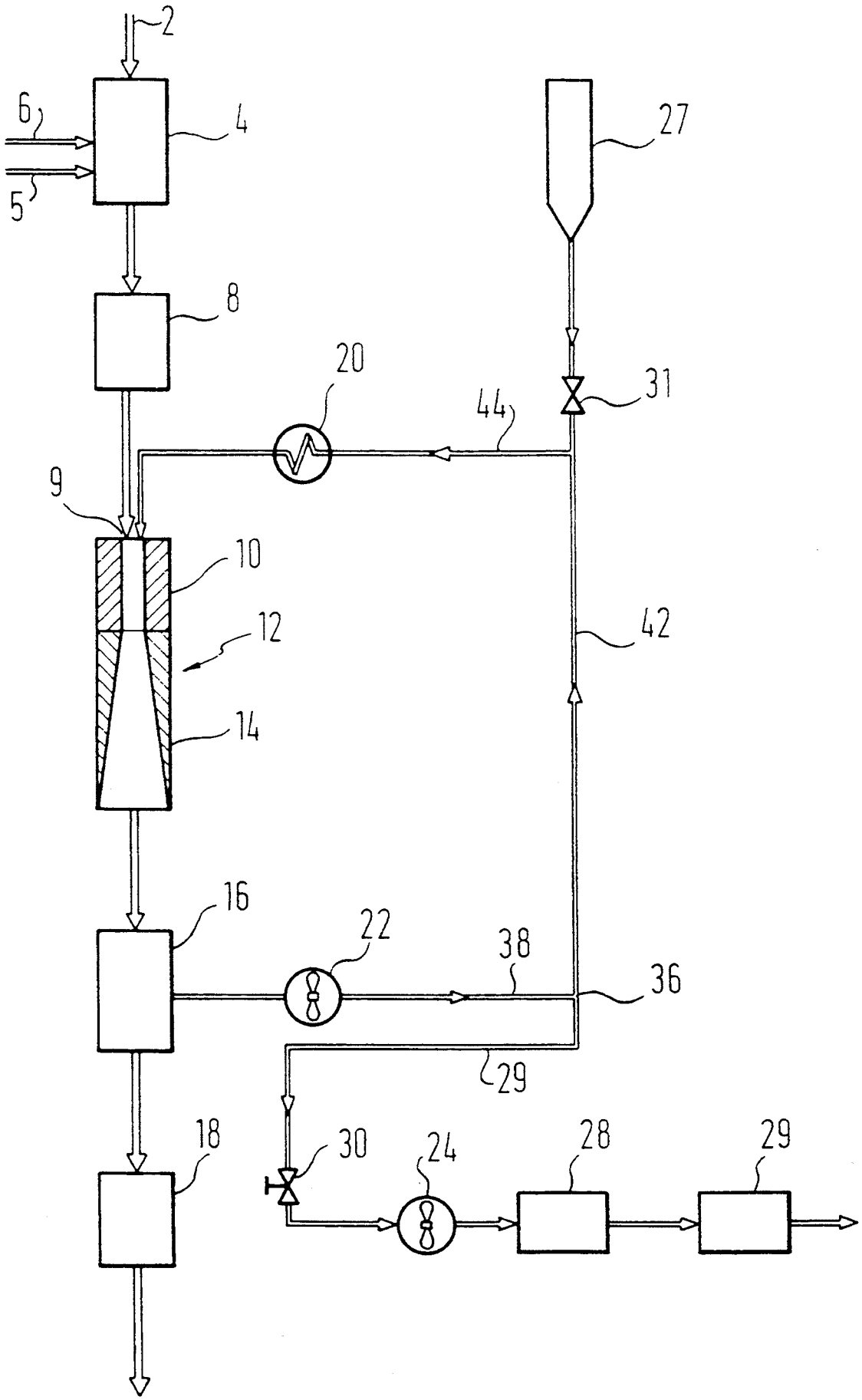
2
6
5
4
27
8
20
31
44
9
10
12
42
14
16
22
38
36
29
18
30
24
28
29

DRYING PROCESS FOR INCREASING THE FILLING POWER OF TOBACCO MATERIAL

BACKGROUND OF THE INVENTION

1. Field of the Invention

The present invention relates to a drying process for increasing the filling power of tobacco material and an apparatus for carrying out said process.

2. Description of the Prior Art

In a technologically sophisticated flow drying of cut tobacco, in which the tobacco material to be dried is dried in a stream of hot drying gas, the aim is to achieve a combination of to some extent contradictory process objectives. The best solution from the process technological point of view is accordingly to obtain an optimum of the relevant desired functions. The different objective functions can be combined in three groups relating to the product and process characteristics. The group of physical product properties includes substantially the objective functions of good tobacco filling power with relatively low cigarette drawing resistance and low degradation, giving stable cigarette ends. The chemical sensorial product properties form the second group, the optimum of which is characterized by high aroma retention, low influence on components and satisfactory smoke flavour. The third group required for optimum procedure is that of a minimum energy consumption and minimum waste gas emissions from the point of view of environmental protection.

The individual objective functions of the three different objective groups are governed substantially by the process parameters set forth in the following table, i.e. the tobacco moisture before and after the drying, the local heat and mass transfer coefficients between the tobacco surface and the surrounding drying gas during the treatment, and the specific heat of the drying gas.

TABLE

| | Product property | | |
|---|---|---|---|
| Process parameters | Tobacco filling power, cigarette draw resistance, cigarette end stability | Smoke flavour, ingredients, aroma retention | Minimum energy consumption, low emissions |
| Tobacco moisture prior to drying | as high as possible, about 40% for cut lamina, related to wet basis | cut moisture prefered; i.e. 18–20% for cut lamina on wet basis | minimum possib. moisture difference |
| Tobacco moisture after drying | as low as possible | at least 12% (cigarette moisture) | minimum possible exit air temperature |
| Local heat and mass transfer coefficient | as high as possible during the treatment | as low as possible during the treatment | |
| Specific heat of the drying gas | as high as possible, for example high water vapour content | minimum water vapour content to avoid steam distillation | high water vapour content |

Optimum physical product properties are achieved by a relatively high tobacco moisture content prior to drying, as a guide 40%, wet weight basis, should be regarded as an upper limit in practice; furthermore a relatively low tobacco moisture content after drying, maximum possible local heat and mass exchange coefficients during the treatment and as high as possible a specific heat of the drying gas, which can for example be achieved by a high water vapour content. In contrast, optimum chemical sensorial product properties require that the tobacco moisture before the drying corresponds substantially to the usual cut tobacco moisture of about 18% to 20% on a wet basis, and the tobacco moisture after drying is not less than the usual cigarette moisture, i.e. about 12%, again on a wet basis. The local heat and mass exchange should be kept as low as possible during the drying; likewise, to avoid steam distillation, the water vapour content in the drying gas should also be kept as low as possible. The required process characteristics to minimise environmental pollution, are represented by as low as possible an exit air temperature and as low as possible a difference in moisture between the tobacco material before and after the drying as well as a low water vapour content in the drying gas.

From DE 34 41 649 A1 a process is known for reducing the moisture content of expanded tobacco in which the expanded tobacco is dried in a drier with hot gas at a temperature within a range of about 340° C. to about 510° C. The residence time within one or more series connected driers is so dimensioned that a tobacco product is obtained having a moisture content of about 3% to about 16% with respect to the weight at the drier output. In particular, the temperature of the drying gas is kept constant within the drier at about 510° C.

DE 31 47 846 A1 discloses a process for improving the filling power of tobacco material by expansion of the moist tobacco material by pressure reduction and subsequent drying to processing moisture content. The tobacco material with a tobacco moisture of 15% to 80% is dried to a moisture content of 2% to 16%, in each case with respect to the moist tobacco material. The temperature of the drying gas is between 50° C. and 1000° C. and preferably is above 100° C. An expansion apparatus is arranged upstream of a drying section and either separated from said drying section or connected thereto to form a unit. Due to the extremely short residence time of the tobacco material to be dried in the expansion apparatus the drying within the expansion apparatus itself can be neglected.

A further process for increasing the volume of comminuted tobacco ribs by impregnation with an impregnating agent containing at least water with subsequent heating of the impregnated tobacco rib parts with a gaseous drying gas containing water vapour is known from DE 30 37 885 A1. The drying gas has a temperature of about 105° C. to about 250° C. The tobacco rib parts are transported by means of a pneumatic transport system through an expansion zone and a drying zone and held for at least about 10 seconds in the expansion and drying zone, being dried to an end moisture content of at least 12.5% by weight. The transport velocity of the tobacco rib parts is preferably reduced in the vertical direction in a cross-sectional widening of the drying zone so that only the parts which are dried to a predetermined drying degree are further conveyed.

In a process known from DE 32 46 513 A1 for drying and loosening cut tobacco the tobacco is introduced into a conduit through which a gas flow with steam and air is conducted with a velocity of more than about 30 m/sec at a temperature in the range from about 260° C. to 370° C. The conduit comprises an elongated tube having a first and second section in tandem array, the first section having a smaller cross-sectional area than the second so that when the gas passes through the pressure in said region decreases. The tobacco within said tube is continuously accelerated without however reaching the velocity of the gas stream.

Processes for improving the filling power of tobacco material in the prior art are carried out in some cases in that the tobacco is impregnated with a vaporizable liquid or a liquefied gas, for example water, $CO_2$, organic solvents, Freon and the like, and said impregnating agent thereafter rapidly vaporized or sublimed. This process has however the disadvantage that although it furnishes an expanded product with increased filling power the tobacco structure generated is not particularly stable. On the contrary, for example in cigarettes with these products a socalled hot collapse is observed, this describing the collapse of the tobacco structure when smoked.

DE-PS 3,130,778 discloses a process for increasing the filling power of tobacco material by a so called shock treatment in which suitably conditioned tobacco material is dried in a stream of hot and rapidly flowing gas within a very short time, that is in less than 1 second. Due to this shock-like treatment the tobacco surface dries within an extremely short time and forms a sort of protective shell for the still moist tobacco interior. Although satisfactory physical product properties can be achieved with this process, the chemo-sensory and economic/ecological aspects are largely ignored.

SUMMARY OF THE INVENTION

It is therefore an object of the invention to provide a process and an apparatus of the type according to the preamble in which the disadvantages of the prior art are eliminated; in particular, the physical and chemo-sensory properties of tobacco material for use as a cigarette filler are to be improved and, in a particularly preferred embodiment of the invention, the pollution of the environment resulting from such a process is to be kept as low as possible.

The invention therefore proposes in a process for increasing the filling power of tobacco material in which the cut and moistened tobacco material is conveyed in a drying gas flow, dried within a tubular drying section and thereafter separated from the drying gas, the drying gas at a feed means into the drying section has a temperature of at least 200° C. and a flow velocity of at least 30 m/s, and the flow velocity of the drying gas is reduced in the drying section, the improvement in which the flow velocity of the drying gas at the feed means is at the most 100 m/s, to reduce the local heat transfer coefficient and the local mass transfer coefficient between the surface of the tobacco material and the surrounding drying gas with the reduction of the flow velocity of the drying gas the flow velocity of the tobacco material in the drying section is also reduced, the flow velocity of the drying gas at the end of the drying section is at the most 15 m/s, and the drying gas has at the end of the drying section a temperature of at the most 130° C.

The invention also proposes in an apparatus for carrying out the process and comprising a tubular drying section for conducting a mixture of drying gas and tobacco material the improvement in which the drying section comprises at its downstream end a cross-sectional area which is 3 to 5 times as great as the cross-sectional area at the upstream end of the drying section.

Further advantageous embodiments of the present invention are disclosed by the features of the subsidiary claims.

The advantages achieved with the process according to the invention are based on the fact that the local heat transfer and local mass transfer coefficient of pretreated, i.e. cut and moist tobacco material, within a drying section in which the tobacco material is conducted for drying in a stream of not gas continually decrease when flowing therethrough from very high values at the beginning of the drying section to comparatively low values at the downstream end of the drying section. As a result, as in the aforementioned shock treatment, the surface of individual cut tobacco pieces is rapidly fixed so that a shell serving as a sort of "corset" for the still moist tobacco material is formed. In the course of the further drying operation however the convection between the tobacco surface and the hot gas surrounding it is then reduced by retarding the flow velocity of said hot gas and of the tobacco material and as a result reducing the local heat transfer End mass transfer coefficient between the tobacco material and the hot gas. This procedure ensures firstly that the initially dried and fixed surface of the tobacco fibre volume enlarged in the moistening process remains dry in the course of the further drying although moisture from the fibre interior continuously diffuses to the fixed surface and secondly that the drying is not intensive enough for the tobacco material to be overheated and undesirably affected as regards flavour.

According to the invention the procedure is also governed by specifying the maximum velocity and maximum temperature of the drying gas at the end of the drying section. The specification of such process parameters according to the invention at the output end of the drying process is to be seen in close relationship with the values of the same parameters at the beginning of the drying section. As a result of optimising the performance of the tobacco drying to fulfil the objectives of maintaining the physical and chemo-sensory properties of the product, as well as satisfying the energy saving requirement leading to a reduction in environmental pollution, the pairs of values of these parameters governing the process at the inlet and outlet ends of the drying section can be defined. The process according to the invention is distinguished by the specification of value pairs in the form of minimum and maximum values at the start and end of the drying operation, whereas the processes known from the prior art only remain very vague in this respect and in particular do not specify such essential process parameters for specific points within the drying apparatus.

Furthermore, by a relatively low mass ratio of drying gas to tobacco material and the resulting high heat and mass exchange area a rapid temperature drop of said drying gas can be achieved. This further counteracts overheating of the tobacco. The energy consumption in the drying can be kept small because the amount of drying gas to be heated is comparatively small and, as will be further explained, the resulting low temperature of the drying gas at the end of the drying process reduces the energy consumption to a minimum. Expediently, this mass ratio of drying gas to tobacco is set to values between 1 and 3.

In a control of the process according to the invention the local heat transfer coefficient at the start of the drying is between 800 and 1000 $J/sm^2K$ and at the end of the drying between 120 and 180 $J/sm^2K$. The local mass transfer coefficient as further essential process parameter is preferably 1 to 2 m/s at the start and 0.15 to 0.25 m/s at the end of the drying.

As further quantity influencing the local heat and mass transfer coefficients, the flow velocity of the hot gas on flowing through the drying section is retarded from a value between 30 and 100 m/s, preferably between 40 and 100 m/s, to at the most 15 m/s preferably a value between 8 to 15 m/s.

Apart from the comparatively high tobacco content in the mixed flow of dry gas and tobacco material, as a short consideration of the energy balance will show a low temperature of the drying gas after drying also contributes to keeping the energy consumption low. Neglecting the energy losses to the environment and the heat of evaporation for evaporating tobacco ingredients, energy is required mainly for evaporating the water contained in the tobacco material. The thermal efficiency serving to characterized the efficiency of the drying can be represented by the formula $$\text{thermal efficiency} = \frac{\text{evaporated amount of water * heat of evaporation}}{\text{energy supplied}}$$

From the energy balance, the energy supplied is:

$$mc_pT_{out}+\Delta m_W h_W$$

where m: exit gas amount $c_p$: mean specific thermal capacity of the exit gas from 0° C. to $T_{out}$ $T_{out}$: temperature of the drying gas at the end of the drying $\Delta m_w$: evaporated water amount $h_w$: heat of evaporation at 0° C., so that for the thermal efficiency the following applies:

$$n_{th} = \frac{\Delta m_W h_W}{mc_p T_{out} + \Delta m_W h_W}$$

It is clear from this simple estimate that the thermal efficiency is the better the lower the exit air amount and temperature. According to the invention the exit air temperature is to be set to less than 130° C., preferably 100° C. to 130° C. According to the invention efficiencies can thus be achieved of up to 85%, certainly not less than 80%.

To advantageously reduce the exit gas quantity and/or the energy consumption, the major part of the drying gas, separated from the dried tobacco by means of a tangential separator or a cyclone, can be directly or indirectly heated in a not gas generator and recycled for further drying.

To minimize the environmental pollution by exit gas emissions, the remaining smaller part of the drying gas with the evaporated tobacco components dispersed therein, is processed in an environmentally compatible manner in a biological waste gas purification apparatus, the investment and operating costs of which rise substantially in direct proportion to the amount of exit gas to be cleaned.

BRIEF DESCRIPTION OF THE DRAWINGS

Further features of the invention and the advantages achievable therewith will be apparent from the description of a preferred example of embodiment and the drawings, wherein:

FIG. 1 shows a schematic illustration of a drying apparatus suitable for carrying out the process according to the invention.

DESCRIPTION OF THE PREFERRED EMBODIMENT

Via a supply conduit 2 cut tobacco material is introduced into a moistening means 4 to which water is supplied via a supply conduit 6.

The moistening means 4 may for example be formed by a moist drum or a moist tunnel. In the moistening means 4 the tobacco material is brought to a moisture content of 18% to 40%, on a wet oasis. Due to the swelling process which then follows the volume of tobacco material increases. The result of this moistening treatment can be additionally further improved by means of steam 5.

Thereafter the moistened tobacco material is conveyed via a gas-tight lock 8 into a pneumatic drying section 12. The drying section 12 consists substantially of two vertical interconnected sections 10, 14. At the inlet point 9 of the drying section 12 the tobacco material is introduced into a stream of drying gas which flows from the top to the bottom through the drying section 12 shown vertically upright in the apparatus illustrated. Apart from the process explained here in which the tobacco material and the drying gas are in down flow, such a drying section 12 may fundamentally have any desired orientation.

At the charging point 9 the temperature of the drying gas previously heated in the hot gas generator 20 is 200° C. to 600° C. and its flow velocity 40 to 100 m/s. At the charging point 9 the drying gas has a water vapour content of 20 to 90 mass percent and the mass ratio of the drying gas to the tobacco material here is between 1 and 3, these values being calculated by the formula:

$$\frac{\text{mass flow of tobacco material}}{\text{mass flow of hot gas}} \times 100 = \text{mass percent}$$

Due to the relatively high velocity of the drying gas with respect to the tobacco material in conjunction with the high drying gas temperature and the water vapour content thereof, at this point within a short time an extremely high local heat and mass exchange results between the drying gas and the moistened tobacco material. The heat transfer coefficient $\alpha$ then arising is about 800 to 1200 J/sm$^2$K and the mass transfer coefficient $\beta$ about 1 to 2 m/s. The high heat and mass transfer leads to a superficial drying and fixing of the swollen tobacco fibre volume arising from the moistening process. In the further course of the process the drying is now controlled in such a manner that firstly the tobacco surface remains dry to avoid softening of the fixed surface by subsequently diffusing water from the fibre interior, but secondly the drying is not too intensive, in order to prevent any overheating and the resulting negative effect on the tobacco flavour. To avoid this, in the short first portion 10 of the drying section 12, which can be constructed as a simple tube piece, the tobacco material is accelerated to approximately drying gas velocity, leading or trailing only by the sinking rate of the tobacco particles. Due to the decreasing relative velocity between the drying gas and tobacco material the heat and mass exchange during the accelerating operation continuously decreases. In the adjoining second portion 14 of the drying section 12 the drying gas, and together therewith the tobacco material, is retarded and the convection at the tobacco surface thereby further reduced. During the retardation operation the relative velocity and thus the heat and mass transer between the tobacco material and the hot gas continuously decreases with progressive drying. For this purpose, the portion 14 of the drying section 12 comprises at its downstream end a cross-sectional area which is 3 to 5 times as great as the cross-sectional area of the portion 10. As a result, at this downstream end of the portion 14 a local heat transfer coefficient of $\alpha=120$ to 180 $J/sm^2K$ and a local mass transfer coefficient $\beta=0.15$ to 0.25 m/s results, as well as a tobacco moisture content of 12% to 15% with respect to the wet basis, a drying temperature of 100° C. to 130° C. and a drying gas velocity of 8 to 15 m/s.

Furthermore, the reduction of the local heat and mass transfer coefficients within the drying section 12 is promoted by the low mass ratio of 1 to 3 of drying gas to tobacco material and the consequently high heat and mass transfer area.

To increase the steam content of the drying gas, water vapour 27 can be additionally introduced into the cycle of the drying gas via a shutoff valve 31. However, with careful sealing of the circuit against infiltrating air this step can be avoided.

The dried tobacco material is now separated from the drying gas via a separating means 16, for example a cyclone or a tangential separator, and discharged out of the drying apparatus 1 via a further gas-tight lock 18.

The drying gas separated from the tobacco material in the separating means 16 is led through a fan 22, a conduit 38, 42, 44 to the hot gas generator 20 and heated to the original drying gas temperature of 200° C. to 600° C. This hot gas generator 20 may be heated optionally directly or indirectly so that the drying gas flow fed back via the conduit 44 can be both directly mixed with additional hot drying gas and heated in direct heat exchange with a suitable heat medium, and hot drying gas can also be employed as such a heat medium.

A smaller proportion of the drying gas, i.e. the exit gas amount, is conducted at the point 36 by a fan 24 via an exit gas conduit 29 and a control valve 30 to a gas washer 28 and thereafter supplied to a biological exit gas cleaning apparatus 29.

We claim:

1. A drying process for increasing the filling power of tobacco material, comprising the steps of:

conveying a cut and moistened tobacco material within a tubular drying section, feeding a drying gas from a feed means into the tubular drying section, the drying gas being fed at a temperature of at least 200° C. and a flow velocity of between 30 m/s and 100 m/s, reducing the flow velocity of the drying as in the tubular drying section, reducing the flow velocity of the tobacco material in the drying section in a manner to reduce the local heat transfer coefficient and the local mass transfer coefficient between the surface of the tobacco material and the surrounding drying gas with the reduction of the flow velocity of the drying gas, the flow velocity of the drying gas at the end of the drying section being brought to a value which is at the most 15 m/s, the drying gas at the end of the drying section being brought to a temperature of at the most 130° C., and separating the tobacco material from the drying gas after the tobacco material has exited the tubular drying section.

2. A process according to claim 1, wherein the local heat transfer coefficient at the start of the drying is 800 to 1000 $J/sm^2K$ and at the end of the drying 120 to 180 $J/sm^2K$.

3. A process according to claim 1, wherein the local mass transfer coefficient at the start of the drying is 1 to 2 m/s and at the end of the drying 0.15 to 0.25 m/s.

4. A process according to claim 1, wherein the ratio of the masses of drying gas to tobacco material during the drying is 1 to 3.

5. A process according to claim 1, wherein the drying gas has at the end of the drying section a flow velocity of at least 8 m/s.

6. A process according to claim 1, wherein the retardation of the flow velocity of the mixture of drying gas and tobacco material is effected by cross-sectional widening in the tubular drying section.

7. A process according to claim 1, wherein the reduction of the local heat transfer coefficient and the local mass transfer coefficient takes place in less than 1 second.

8. A process according to claim 1, wherein the drying gas has at the start of the drying a water vapour content of 20 to 90 mass percent.

9. A process according to claim 1, wherein water vapour is supplied to the drying gas.

10. A process according to claim 1, wherein at the start of the drying section the drying gas has a temperature of at the most 600° C. and at the end of the drying section a temperature of at least 100° C.

11. A process according to claim 1, wherein the tobacco at the start of the drying has a moisture content of 18% to 40% and the dried tobacco content has a moisture content of 12% to 15%, in each case with respect to the moist tobacco material.

12. A process according to claim 1, wherein the thermal efficiency of the drying is at least 80%.

13. A process according to claim 1, wherein the mixture of drying gas and tobacco material is separated after the drying and a major proportion of the drying gas is returned to the drying operation, and a minor proportion of the drying gas is purified in a biological exit gas cleaning apparatus.

14. A process according to claim 1, wherein the drying gas to be supplied to the drying operation is heated to its operating temperature in a hot gas generator which is optionally heatable directly or indirectly.

15. A process according to claim 1, wherein the retardation of the flow velocity of the mixture of drying gas and tobacco material is effected by temperative reduction.

16. A process according to claim 1, wherein the retardation of the flow velocity of the mixture of drying gas and tobacco material is effected by temperative reduction and cross-sectional widening in the tubular drying section.

17. A process according to claim 1, wherein said step a) of conveying includes accelerating the tobacco within a first portion of said tubular drying section to approximately the flow velocity of the drying gas.

18. A process according to claim 17, wherein said first portion has a substantially constant cross-sectional area.

19. A process according to claim 17, wherein each of said steps d) and e) of reducing the flow velocity of the drying gas and the tobacco material, respectively, includes feeding the drying gas and tobacco material within a second portion of said tubular drying section, said second portion expanding in cross-sectional area toward a downstream portion thereof.

20. A process according to claim 19, wherein a downstream end of said second portion has a cross-sectional area which is between 3 to 5 times as large as a cross-sectional area of said first portion.

* * * * *